US006679074B2

(12) United States Patent
Hanson

(10) Patent No.: US 6,679,074 B2
(45) Date of Patent: Jan. 20, 2004

(54) AUTOMATIC SWITCHING REFRIGERATION SYSTEM

(75) Inventor: Jay Lowell Hanson, Bloomington, MN (US)

(73) Assignee: Thermo King Corporation, Minneapolis, MN (US)

( * ) Notice: Subject to any disclaimer, the term of this patent is extended or adjusted under 35 U.S.C. 154(b) by 0 days.

(21) Appl. No.: 10/207,553

(22) Filed: Jul. 29, 2002

(65) Prior Publication Data

US 2003/0024256 A1 Feb. 6, 2003

Related U.S. Application Data

(60) Provisional application No. 60/309,081, filed on Jul. 31, 2001.

(51) Int. Cl.[7] ..... F25B 13/00

(52) U.S. Cl. ..... 62/160; 62/228.5; 62/229

(58) Field of Search ..... 62/160, 159, 228.5, 62/229, 209

(56) References Cited

U.S. PATENT DOCUMENTS

| | | | | |
|---|---|---|---|---|
| 3,973,618 | A | | 8/1976 | Naley et al. |
| 4,509,586 | A | | 4/1985 | Watabe |
| 4,535,598 | A | | 8/1985 | Mount |
| 4,569,476 | A | | 2/1986 | Watabe |
| 4,663,725 | A | | 5/1987 | Truckenbrod et al. |
| 4,715,190 | A | | 12/1987 | Han et al. |
| 4,918,932 | A | * | 4/1990 | Gustafson et al. ..... 62/89 |
| 4,977,752 | A | | 12/1990 | Hanson |
| 5,123,252 | A | | 6/1992 | Hanson |
| 5,161,384 | A | | 11/1992 | Hanson et al. |
| 5,172,561 | A | | 12/1992 | Hanson et al. |
| 5,201,186 | A | | 4/1993 | Hanson |
| 5,209,072 | A | | 5/1993 | Truckenbrod et al. |
| 5,222,368 | A | | 6/1993 | Hanson |
| 5,275,011 | A | | 1/1994 | Hanson et al. |
| 5,276,630 | A | * | 1/1994 | Baldwin et al. ..... 364/505 |
| 5,284,024 | A | | 2/1994 | Hanson et al. |
| 5,295,364 | A | | 3/1994 | Truckenbrod et al. |
| 5,315,840 | A | | 5/1994 | Viegas et al. |
| 5,320,167 | A | | 6/1994 | Johnson et al. |
| 5,369,957 | A | | 12/1994 | Hanson |
| 5,458,188 | A | | 10/1995 | Roehrich et al. |
| 5,494,097 | A | | 2/1996 | Straub et al. |
| 5,499,512 | A | * | 3/1996 | Jurewicz et al. ..... 62/229 |
| 5,557,941 | A | * | 9/1996 | Hanson et al. ..... 62/160 |
| 5,579,648 | A | | 12/1996 | Hanson et al. |
| 5,634,347 | A | | 6/1997 | Hanson et al. |
| 5,730,216 | A | | 3/1998 | Viegas et al. |
| 5,860,594 | A | | 1/1999 | Reason et al. |
| 5,921,090 | A | | 7/1999 | Jurewicz et al. |
| 6,027,031 | A | | 2/2000 | Reason et al. |
| 6,487,869 | B1 | * | 12/2002 | Sulc et al. ..... 62/230 |

* cited by examiner

*Primary Examiner*—Marc Norman
(74) *Attorney, Agent, or Firm*—Michael Best & Friedrich LLP

(57) ABSTRACT

A method of operating a refrigeration system having a discharge port that guides conditioned air from the system to a conditioned space and a return port that guides air from the conditioned space back to the system. The method comprises providing a first control algorithm and second control algorithm for controlling the system. The first control algorithm is a function of the air temperature at the discharge port, and the second control algorithm is a function of the air temperature at the return port. The method further comprises operating the system using the first control algorithm when a first condition is met, operating the system using the second control algorithm when a second condition is met, and automatically switching between the first control algorithm and the second control algorithm depending on the status of the first and second conditions.

24 Claims, 5 Drawing Sheets

AUTOMATIC SWITCHING REFRIGERATION SYSTEM

CROSS-REFERENCE TO RELATED APPLICATION

This application claims priority under 35 U.S.C. §119 to a provisional patent application No. 60/309,081, filed on Jul. 31, 2001.

FIELD OF THE INVENTION

The invention relates generally to air conditioning and refrigeration systems, and more specifically to a method of controlling the operation of a refrigeration system with temperature sensors located in the return air port and discharge air port.

BACKGROUND OF INVENTION

Refrigeration systems control the temperature of a load space to stay within a desired temperature range surrounding a set point temperature. The load space air temperature is measured by a sensor disposed in either the path of air returning to the refrigeration system from the load space (return air), or in the path of air discharged from the refrigeration system to the load space (discharge air). Some uses of refrigeration systems have a preference for return air control and some have a preference for discharge air control. As disclosed in U.S. Pat. Nos. 3,973,618 and 4,977,752, both assigned to the same assignee as the present application, both a return air sensor and a discharge air sensor may be provided.

Many factors influence the load space air temperature. Warm or cool ambient air may enter the load space and affect the load space air temperature when the load space door is ajar. Additionally, when the refrigeration system is used in connection with a transportable load space, e.g. a truck trailer, the warmth of the sun hitting the exterior of the load space, a cool rain or snow hitting or accumulating on top of the load space, or even a change in altitude as the load travels from point to point can influence the load space air temperature. Therefore, the temperature of the conditioned air required to maintain the load space air temperature in the desired set point range changes as the load space air temperature is influenced by these factors. In some instances it becomes necessary to switch between return air control and discharge air control to maintain the load space air temperature within the desired set point range.

Currently available refrigeration systems require manual switching between return air control and discharge air control. In these applications, an operator must monitor the operating conditions of the air-conditioned space and the refrigeration system and then must switch between return air control and discharge air control based upon these conditions.

SUMMARY OF INVENTION

The present inventive method of operating a refrigeration system is designed to condition a conditioned space to a set point temperature. The refrigeration system includes a discharge port that guides conditioned air from the system to the conditioned space and a return port that guides air from the conditioned space back to the system. The method comprises providing a first control algorithm and second control algorithm for controlling the system. The first control algorithm is a function of the air temperature at the discharge port, and the second control algorithm is a function of the air temperature at the return port. The method further comprises operating the system using the first control algorithm when a first condition is met, operating the system using the second control algorithm when a second condition is met, and automatically switching between the first control algorithm and the second control algorithm depending on the status of the first condition and the second condition.

In preferred embodiments, the method further comprises measuring the temperature of ambient air outside of the conditioned space, comparing the ambient air temperature to the set point, controlling the system utilizing the first control algorithm if the ambient air temperature is greater than or equal to the set point, and controlling the system utilizing the second control algorithm if the ambient air temperature is less than the set point.

Operating the system using the second control algorithm when the second condition is met includes operating the system in the high speed heat mode if the return air temperature is more than about 5 degrees below the set point and operating the system in the low speed heat modulation mode if the return air temperature is less than about 1.5 degrees above the set point.

The system can also operate in the first control algorithm in a low speed cool modulation mode and a low speed cool mode. Operating the system using the first control algorithm when the first condition is met includes operating the system in low speed cool mode if the return air temperature is less than about 0.5 degrees below the set point and operating the system in low speed cool modulation mode if the return air temperature is less than about 3 degrees above than the set point.

Additional features and advantages of the invention will become apparent to those skilled in the art upon consideration of the following detailed description, claims, and drawings.

BRIEF DESCRIPTION OF DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF DRAWINGS

Figure 1:
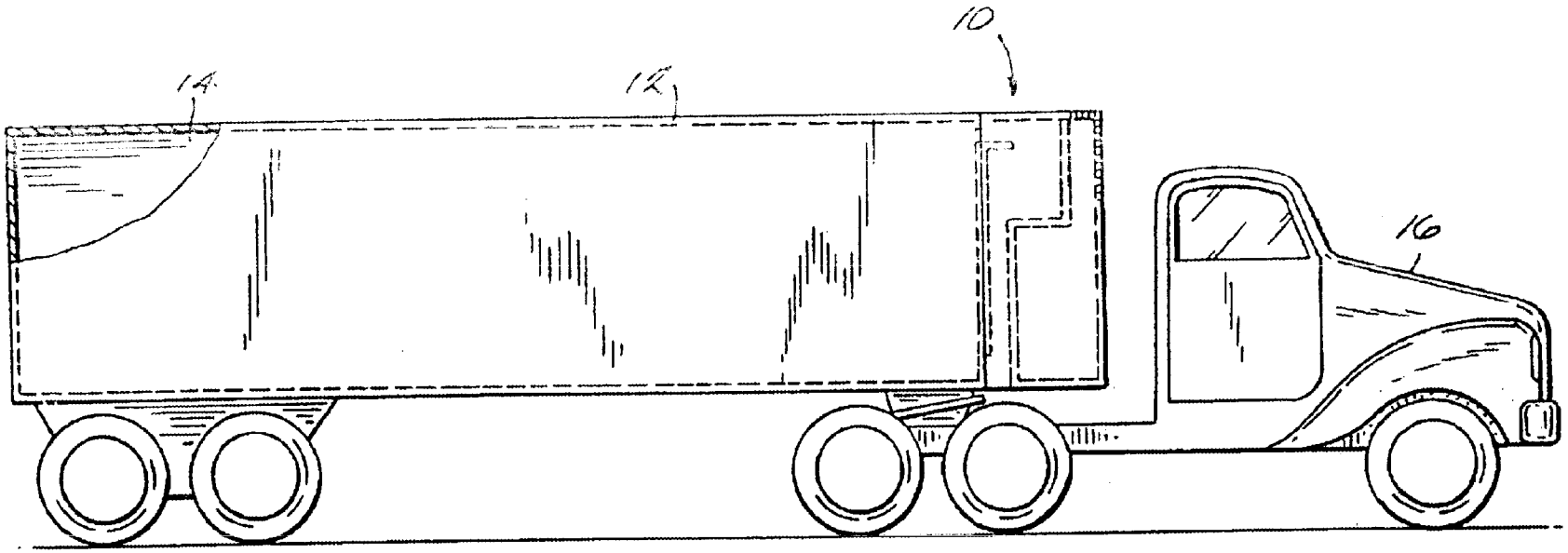
FIG. 1 is a side view, partially in section, of a vehicle having a refrigeration system embodying the present invention.
Figure 2:
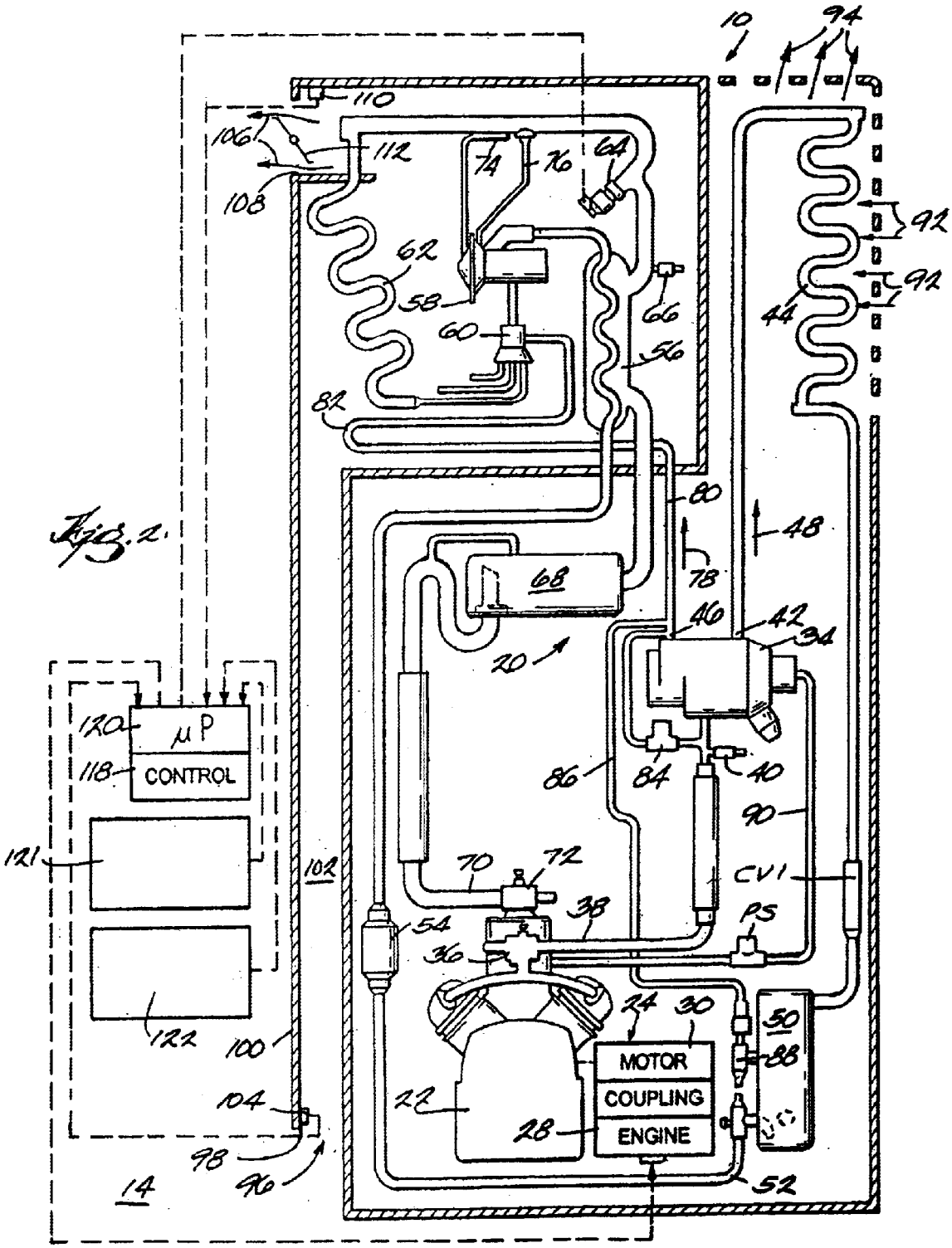
FIG. 2 is a schematic representation of the refrigeration system of FIG. 1.

Referring now to the drawings, FIGS. 1 and 2 show a refrigeration system 10 that may utilize the present inventive method. The refrigeration system 10 is especially suitable for use in transport applications and may be mounted on a container, truck, trailer, or any other type of transport vehicle that has a conditioned space that needs to maintain a predetermined temperature to preserve the quality of the cargo. FIG. 1 shows the unit 10 mounted on a trailer 12 having a conditioned space 14. The trailer 12 is pulled by a tractor 16, as is understood by those skilled in the art.

The refrigeration system 10 controls the temperature in the conditioned space 14 to a specified temperature range adjacent to a selected set point. The conditioned space 14 may also be divided into a plurality of conditioned spaces having the temperatures in each conditioned space being substantially independently controlled by the refrigeration system 10. As seen in FIG. 2, the refrigeration system 10 has a closed fluid refrigerant circuit or flow path 20 that includes a refrigerant compressor 22 driven by a prime mover arrangement 24. The prime mover arrangement 24 of the preferred embodiment includes an internal combustion engine 28 and an optional stand-by electric motor 30. The engine 28 and the motor 30, when both are utilized, are coupled to the compressor 22 by a suitable clutch or coupling 32 which disengages the engine 28 while the motor 30 is operative.

Discharge ports of the compressor 22 are connected to an inlet port of a three-way valve 34 via a discharge service valve 36 and a discharge line 38. A discharge pressure transducer 40 is located in the discharge line 38, upstream of the three-way valve 34, to measure the discharge pressure of the compressed refrigerant. The functions of the three-way valve 34, which selects heating and cooling cycles, may be provided by two separate valves, if desired. The three-way valve 34 has a first outlet port 42, which is selected to initiate a cooling cycle, with the first outlet port 42 being connected to the inlet side of a condenser coil 44. The three-way valve 34 has a second outlet port 46, which is selected to initiate a heating cycle.

When the three-way valve 34 selects the cooling cycle outlet port 42, it connects the compressor 22 in a first refrigerant flow path 48 (represented by an arrow), which in addition to the condenser coil 44, includes a one-way condenser check valve CV1, a receiver 50, a liquid line 52, a refrigerant drier 54, a heat exchanger 56, an expansion valve 58, a refrigerant distributor 60, an evaporator coil 62, an electronic throttling valve 64, a suction pressure transducer 66, another path through the heat exchanger 56, an accumulator 68, a suction line 70, and back to a suction port of compressor 22 via a suction line service valve 508. The expansion valve 58 is controlled by a thermal bulb 74 and an equalizer line 76.

When the three-way valve 34 selects the heating cycle outlet port 46, it connects the compressor 22 in a second refrigerant flow path 78 (represented by an arrow). The second refrigerant flow path 78 by-passes the condenser coil 44 and the expansion valve 58, connecting the hot gas output of compressor 22 to the refrigerant distributor 60 via a hot gas line 80 and a defrost pan heater 82. A hot gas by-pass solenoid valve 84 may optionally be disposed to inject hot gas into the hot gas line 80 during a cooling cycle. A by-pass or pressurizing line 86 connects the hot gas line 80 to the receiver 50 via by-pass and check valves 88, to force refrigerant from the receiver 50 into an active refrigerant flow path during heating and defrost cycles.

A conduit or line 90 connects the three-way valve 34 to the low pressure side of the compressor 22 via a normally closed pilot solenoid valve PS. When the solenoid valve PS is de-energized and thus closed, the three-way valve 34 is spring biased to select the cooling cycle outlet port 42. When the evaporator coil 62 requires defrosting, and when cargo is being conditioned in the conditioned space 14 requires heat to maintain set point, the pilot solenoid valve PS is energized and the low pressure side of the compressor 22 operates the three-way valve 34 to select the heating cycle outlet port 46 to initiate a heating cycle or a defrost cycle.

A condenser fan or blower (not shown), which may be driven by the prime mover arrangement 24, causes ambient air 92 to flow through the condenser coil 44, with the resulting heated air 94 being discharged to the atmosphere. An evaporator fan or blower (not shown), which also may be driven by the prime mover arrangement 24, draws air 96, called "return air", from the conditioned space 14, through an inlet 98 in a bulkhead 100 and up through a bulkhead space 102. The bulkhead 100 preferably runs the entire height of the conditioned space 14. A return air temperature sensor 104 samples the air temperature from the bottom of the conditioned space 14.

The resulting conditioned cooled or heated air 106, called "discharge air", is returned or discharged by a fan (not shown) into the conditioned space 14 via an outlet 108. A discharge air temperature sensor 110 is located in the outlet 108 and records the temperature of the discharge air 106. During an evaporator defrost cycle, a defrost damper 112 may be operated to close the discharge air path to the conditioned space 14.

The transport refrigeration system 10 is controlled by an electrical control 118 which includes a microprocessor based controller 120 and electrical control circuits and components, including relays, solenoids, and the like. The controller 120 receives input signals from appropriate sensors, including inputs from a set point selector 121, which may be actuated to select the desired set point temperature in the conditioned space 14, an ambient air temperature sensor 122, the return air temperature sensor 104, the discharge temperature sensor 110, a coil temperature sensor and switch (not shown) disposed to sense the temperature of the evaporator coil 62, the discharge pressure transducer 40, the suction pressure transducer 66, and a throttle or high speed solenoid 124 that selects high and low speed operating speeds of engine 28. The controller 120 provides output signals to, among other things, the electronic throttling valve 64 to control the positioning of the electronic throttling valve 64, as described above.

Figure 3:
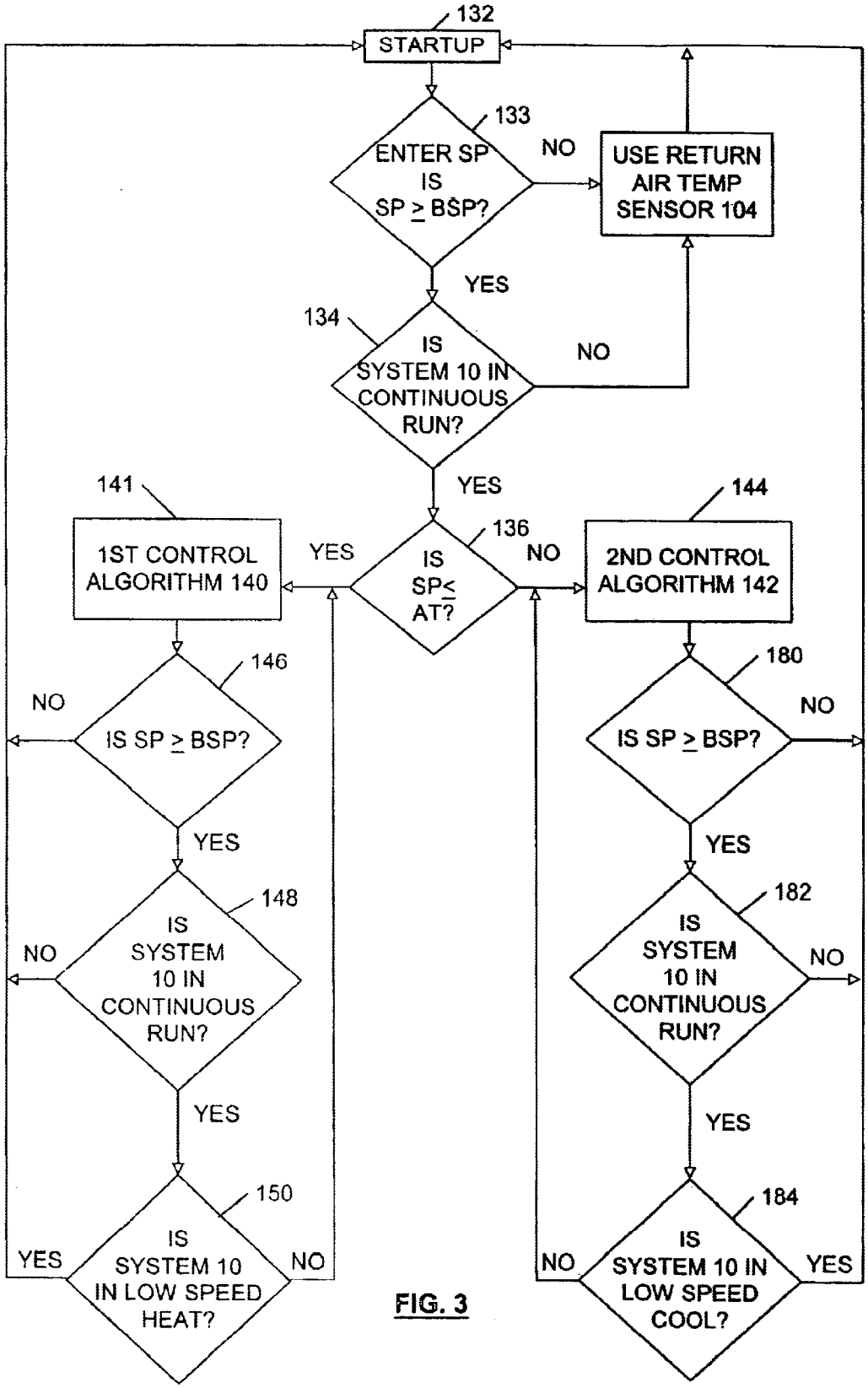
FIG. 3 is a flow chart showing a method of controlling a transport refrigeration system having cooling and heating cycles for cooling and heating a conditioned space.

FIG. 3 illustrates an algorithm in the form of a computer program 130 that can be used to practice the method of the present invention. Additionally, the program 130, among other things, selects operation in either a first control algorithms 140 or a second control algorithm 142 (described in detail below). The program 130 starts at block 132. At block 132, the program 130 initiates a startup program, which may include, but is not limited to turning system 10 unit on, powering-up the system 10, checking for errors in the system 10 and any other initialization sequences that may occur during start-up of the system 10 and/or the controller 120.

After the program 130 initiates startup, a frozen temperature range or a fresh temperature range can be selected by the operator. The frozen temperature range can vary between the minimum temperature of the refrigeration system 10 (e.g., $-25_{[1D1]}$° F.) and a predetermined barrier set point ("BSP"). The barrier set point is a temperature that is a barrier between the frozen temperature range and the fresh temperature range. In the preferred embodiment, the barrier set point temperature is 15.0° F., however, any barrier set point temperature BSP can be used and still be within the scope of the present invention. Generally, the barrier set point temperature BSP is entered by a system administrator and the operator cannot adjust the barrier set point temperature BSP.

In block, 133 the program 130 prompts the operator to enter a set point temperature ("SP"). The set point temperature SP is a function of the cargo and is generally between approximately −25° F. and 90° F., however, in other embodiments, other set point temperature ranges can also be available. If the operator enters a set point temperature SP that is less than the barrier set point BSP, the program 130 will operate the refrigeration system 10 in a frozen mode and will use temperature data supplied by the return air temperature sensor 104. In the frozen mode, the high speed heating function (described below) is locked out and the refrigeration system 10 cycles between operation in cooling and defrost cycles. Additionally, during operation in the frozen mode, the program 130 continually compares the set point temperature SP and the barrier set point temperature BSP. If the set point temperature SP is changed to a temperature that is greater than or equal to the barrier set point temperature BSP, the program 130 switches out of operation in the frozen mode and operates in the fresh mode. Conversely, if the operator enters a set point temperature SP that is greater than or equal to the barrier set point temperature BSP (Yes at block 132), the program 130 operates the refrigeration system 10 in the fresh mode and proceeds to block 134.

The controller 120 is programmed to operate the refrigeration system 10 in a cycle sentry mode or in a continuous run mode. The operator generally chooses operation in either the cycle sentry mode or the continuous run mode at system start up based upon the cargo. The cycle sentry mode cycles the refrigeration system 10 between on and off to achieve the set point temperature SP. If the temperature within the conditioned space 14 is acceptable, the refrigeration system 10 will go to null (off) until the temperature is no longer acceptable. When the temperature is no longer acceptable, the refrigeration system 10 will turn on or restart to bring the conditioned space temperature back to an acceptable temperature.

Referring to block 134, if the operator selected the sentry cycle mode (No at block 134), the program 130 will use temperature data supplied by the return air temperature sensor 104 to control operation of the refrigeration system 10. Alternatively, if the operator selected the continuous run mode (Yes at block 134), the program proceeds to block 136. The continuous run mode runs the refrigeration system 10 continuously. The refrigeration system 10 does not shut off when the conditioned space 14 has an acceptable temperature. Rather, the refrigeration system 10 continuously cycles between heating, cooling, and defrost cycles.

Referring to block 136, the ambient air temperature sensor 122 records the ambient air temperature ("AT") and the program 130 determines if the set point temperature SP is greater or less than the ambient air temperature AT. When the set point temperature SP is less than or equal to the ambient air temperature AT (Yes at block 136), the program 130 continues to block 141, selects the first control algorithm 140, and receives temperature date from the discharge air temperature sensor 110. When the set point temperature SP is greater than the ambient air temperature AT (No at block 136), the program 130 continues to block 144, selects the second control algorithm 142, and receives temperature data from the return air temperature sensor 104.

Referring first to operation using the first control algorithm 140, which, as mentioned above, is based on discharge air control. Once, the first control algorithm 140 is selected, the program 130 proceeds to block 146 and determines if the set point temperature SP is greater or less than the barrier set point temperature BSP. If the set point temperature SP has been changed and the set point temperature SP is now less than the barrier set point temperature BSP (No at block 146), the program 130 moves to block 132. If the set point temperature SP is greater than or equal to the barrier set point temperature BSP (Yes at block 146), the program 130 proceeds to block 148.

In block 148, the program 130 determines if the refrigeration system 10 has been switched to operation in the cycle sentry mode or remains in the continuous run mode. If the refrigeration system 10 is operating in the cycle sentry mode (No at block 148), the program 130 returns to block 132. If the refrigeration system 10 is operating in continuous run (Yes at block 148), the program 130 proceeds to block 150.

In block 150, the program 130 determines if the refrigeration system 10 is operating in a low speed heat mode ("LSHM"). If the refrigeration system 10 is operating in the low speed heat mode LSHM (described in detail below), the program 130 returns to block 132. If the refrigeration system 10 is not operating in the low speed heat mode LSHM (No at block 150), the program 130 returns to block 141 and continues to operate using the first control algorithm 140. The program 130 continuously cycles through blocks 141, 146, 148, and 150 using the first control algorithm 140 and data from the discharge air temperature sensor 110 until one of the above mentioned conditions is met and the program 130 proceeds to block 132. Therefore, the program 130 will automatically switch between operation in the first and second control algorithms 140, 142 if the set point temperature SP is changed. Similarly, the program 130 will automatically switch between operation in the first and second control algorithms 140, 142 if the ambient temperature AT moves above or below the set point temperature SP.

Figure 4:
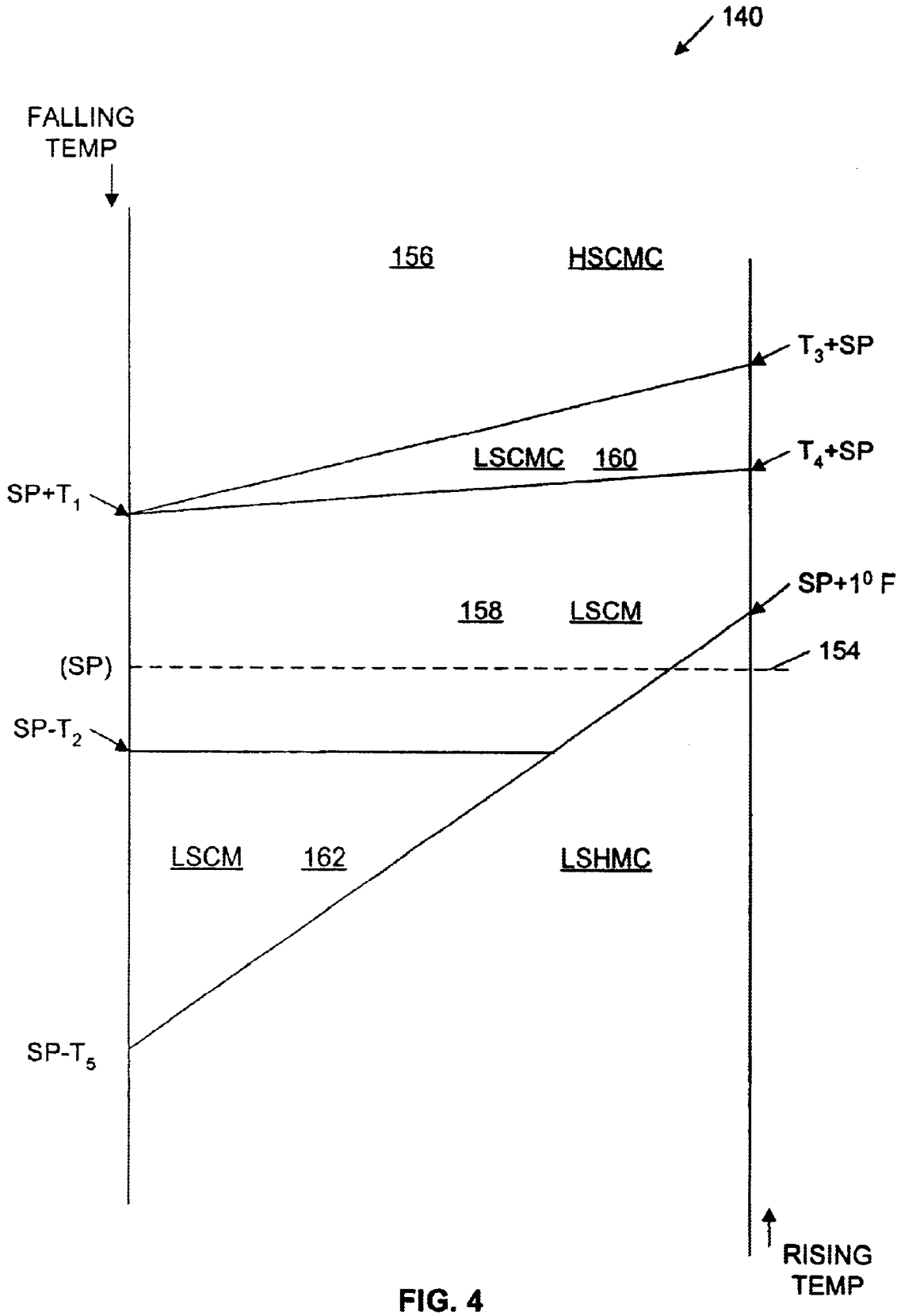
FIG. 4 is a temperature control chart representing temperature control values and ranges for the method shown in FIG. 3 when the refrigeration system is operating using a first control algorithm.

FIG. 4 illustrates the first control algorithm 140 in detail, which as mentioned above, is based upon discharge air control. More specifically, when the program 130 is operating in the first control algorithm 140, the discharge air sensor 110 (see FIG. 2) measures the temperature of the discharge air ("TDA") and the controller 120 compares the temperature of the discharge air TDA to the set point temperature SP. Measuring the conditioned air temperature at the discharge air sensor 106 ensures that the cargo does not experience top freeze when the ambient air temperature AT is greater than or equal to the set point SP.

In FIG. 4 operation with a falling temperature in the conditioned space 14 is indicated along the left axis, starting at the top, and operation with a rising temperature in the conditioned space 14 is indicated along the right axis, starting at the bottom. Additionally, the set point temperature SP is represented by line 154.

Starting on the top of the left axis in FIG. 4, the first control algorithm 140 operates the system 10 in high speed cool maximum capacity ("HSCMC") if temperature of the discharge air 106 is within a temperature range 156. The temperature range 156 has a lower limit of sum of a predetermined temperature value ("$T_1$"), such as for example 3° F., and the set point temperature SP. In high speed cool maximum capacity HSCMC, a maximum amount of refrigerant is directed along the first refrigerant flow path 48 to cool the conditioned space 14. Alternatively or in addition, the compressor 22 is operated at maximum speed.

As the temperature of the discharge air TDA decreases, the temperature of the discharge air TDA enters a temperature range 158. The temperature range 158 has an upper limit of the sum of the set point temperature SP and the first predetermined temperate value $T_1$. The lower limit of the temperature range 158 is the set point temperature minus a second predetermined temperature control value ("$T_2$"), such as for example −0.5° F. When the discharge air temperature TDA enters the temperature range 158, the first control algorithm 140 switches to a low speed cool modulation mode ("LSCM"). When the system 10 operates in LSCM mode 158, the prime mover 124 operates at a low speed and the controller 120 controls the throttling valve 64 to modulate the amount of refrigerant being directed through the first refrigerant flow path 48. Preferably, the first control algorithm 140 continues to operate the system 10 in low speed cool modulation LSCM until the cargo is unloaded or the system 10 is shut down. However, changes in weather, ambient temperature AT, opening and closing a conditioned space door (not shown), poor insulation in the conditioned space 14, and other conditions can cause the discharge air temperature TDA and the temperature in the conditioned space 14 to change, requiring the first control algorithm 140 to switch to other modes of operation.

A high point of a temperature range 160 is defined by the sum of the set point temperature SP and a third predetermined temperature value $T_3$ (e.g., 8.0° F.) and a low point of the temperature range 160 is defined by sum of the set point temperature SP and a fourth predetermined temperature value $T_4$ (e.g., 5.0° F.). If the discharge air temperature TDA enters the temperature range 160, the first control algorithm 140 operates the system 10 in a low speed cool maximum capacity mode ("LSCMC") for a predetermined time period (e.g., 8 minutes). If during the predetermined time period the discharge air temperature TDA falls below sum of the set point temperature SP and the first predetermined temperature value $T_1$, the first control algorithm 140 will operate the system 10 in low speed cool modulation LSCM. If during the predetermined time period, the discharge air temperature TDA does not fall below the sum of set point temperature SP and the first predetermined temperature value $T_1$ or the discharge air temperature TDA rises above the sum of the set point temperature SP and the third predetermined temperature $T_3$, the first control algorithm 140 operates the system 10 in high speed cool maximum capacity HSCMC. The system 10 will continue to operate in high speed cool maximum capacity HSCMC until the discharge air temperature TDA returns to the temperature range 158.

The set point temperature SP minus the second predetermined temperature value T2 defines a high point of a temperature range 162. The set point temperature SP minus a fifth predetermined temperature value ("T5"), such as for example 2.0° F., defines a low point of the temperature range 162. If the temperature of the discharge air 106 drops below the sum of the second predetermined temperature $T_2$, the first control algorithm 140 initiates a timed integral (e.g., 100° per minute), the duration of which is selected based upon cargo conditions. During the timed integral, the first control algorithm 140 operates the system 10 in low speed cool modulation LSCM. If the timed integral expires before the discharge air temperature TDA rises above the sum of the set point temperature SP and the second predetermined temperature $T_2$, the first control algorithm 140 shifts the system 10 into the low speed heat maximum capacity ("LSHMC"). Additionally, the first control algorithm 140 prevents the system 10 from leaving the low speed heat mode LSHM until the discharge air temperature TDA rises more than 1° F. above the set point temperature SP. If the discharge air temperature DTA returns to the temperature range 158 before the timed integral expires, the first control algorithm 140 continues to operate the system 10 in low speed cool modulation LSCM. As mentioned above and shown in FIG. 3, if the system 10 operates in low speed heat maximum capacity LSHMC, the program 130 proceeds to block 132, and automatically switches between operation using the first control algorithm 140 to operation using the second control algorithm 142.

Referring to block 136 (FIG. 3), when the set point temperature SP is greater than the ambient air temperature AT (No at block 136), the program 130 continues to block 144, selects the second control algorithm 142, and receives temperature readings from the return air temperature sensor 104.

Once the second control algorithm 142 is selected, the program 130 proceeds to block 180 and determines if the set point temperature SP is greater or less than the barrier set point temperature BSP. If the set point temperature SP is less than the barrier set point temperature BSP (No at block 180), the program 130 proceeds to block 132. If the set point temperature SP is greater than or equal to the barrier set point temperature BSP (Yes at block 180), the program 130 proceeds to block 182.

In block 182, the program 130 determines if the refrigeration system 10 is operating in the cycle sentry mode or in continuous run. If the refrigeration system 10 is operating in the cycle sentry mode (No at block 182), the program 130 returns to block 132. If the refrigeration system 10 is operating in continuous run (Yes at block 182), the program 130 proceeds to block 184.

In block 184, the program 130 determines if the refrigeration system 10 is operating in the low speed cool maximum capacity LSCMC. If the refrigeration system 10 is operating in low speed cool maximum capacity LSCMC, the program 130 returns to block 132. If the refrigeration system 10 is not operating in the low speed heat mode LSHM (No at block 184), the program 130 returns to block 144 and continues to operate using the second control algorithm 142. The program 130 continuously cycles through blocks 144, 180, 182, and 184 using the second control algorithm 142 until one of the above mentioned conditions is met and the program 130 proceeds to block 132.

Figure 5:
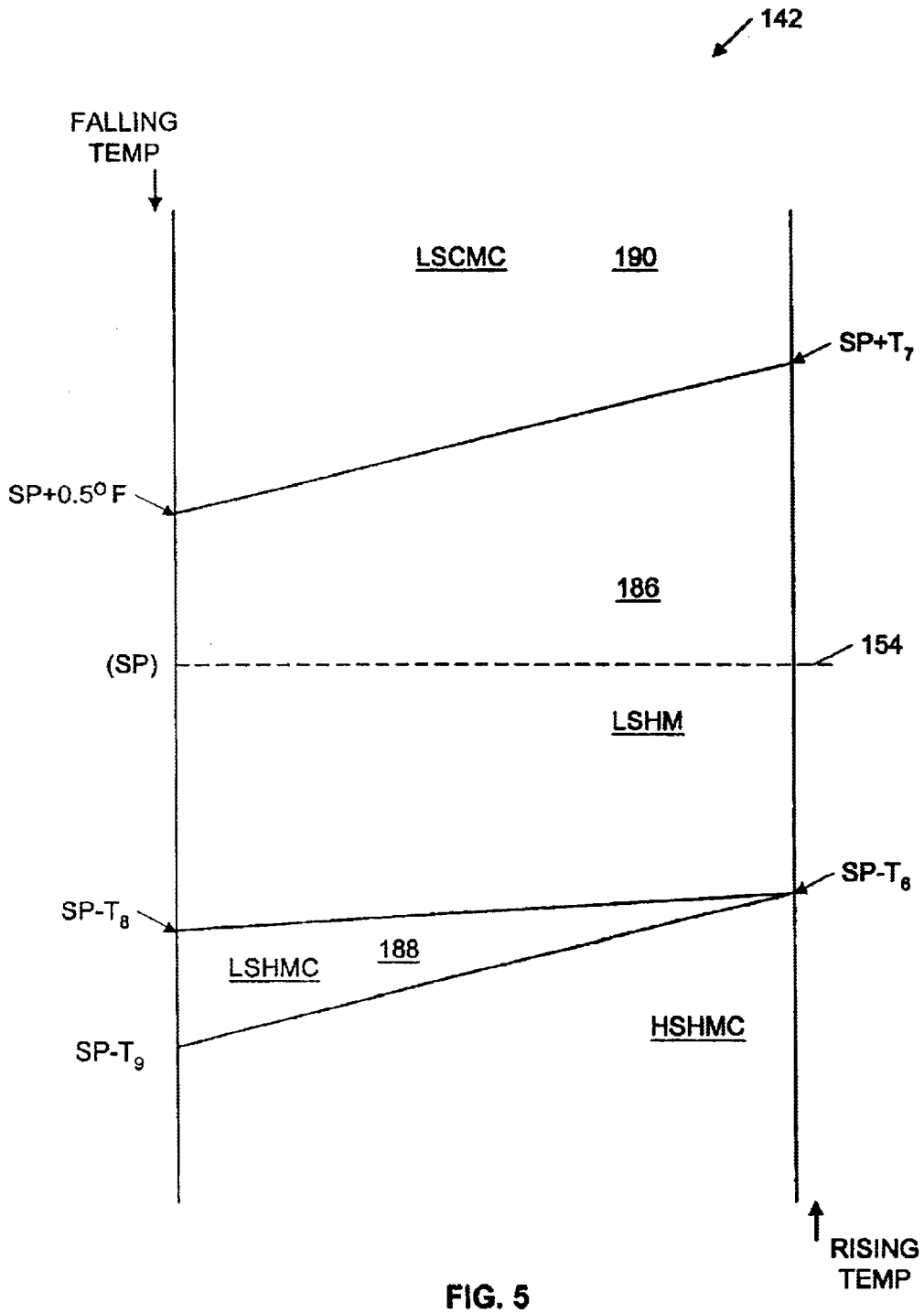
FIG. 5 is a temperature control chart representing temperature control values and ranges for the method shown in FIG. 3 when the refrigeration system is operating using a second control algorithm.

FIG. 5 illustrates the second control algorithm 142, which as mentioned above, is based upon return air control. Measuring the conditioned air temperature at the return air sensor 104 ensures that the cargo does not experience bottom freeze when the ambient air temperature AT is less than the set point SP. As noted above, the second control algorithm 142 is utilized when AT is less than the set point temperature SP.

The vertical axis on the left and right side of FIG. 5 corresponds with the return air temperature ("TRA") as measured by the return air temperature sensor 104 (see FIG. 2). As noted above, the left axis is used when the return air temperature TRA is decreasing and the right axis is used when the return air temperature TRA is rising.

Starting from the lower right axis, the second control algorithm 142 calls for running the system 10 in a high speed heat mode ("HSHM") until the return air temperature TRA rises to the set point temperature SP minus a sixth predetermined temperature value ("$T_6$"), such as for example 2.0° F. In the high speed heat mode HSHM a maximum quantity of refrigerant is directed along the second refrigerant flow path 78 and heating elements located in the refrigeration system 10 (e.g., the heater 82 and electric heating elements) are operated at their maximum capacities.

If the return air temperature TRA comes within a temperature range 186, the program 130 operates the system 10 in low speed heat modulation ("LSHM"). The temperature range 186 has an upper limit of the sum of the set point temperature SP and a seventh predetermined temperature value ("$T_7$"), such as for example 1.5° F. The set point temperature SP minus the sixth predetermined temperature value $T_6$ defines a lower limit of the temperature range 186. Preferably, the second control algorithm 142 continues to operate the system 10 in low speed heat modulation LSHM until the cargo is unloaded or the system 10 is shut down. However, as mentioned above, changes in weather, ambient temperature AT, opening and closing a conditioned space door (not shown), poor insulation in the conditioned space 14, and other conditions can cause the discharge air temperature TDA and the temperature in the conditioned space 14 to change, requiring the second control algorithm 142 to switch to other modes of operation.

A temperature range 188 has an upper limit of the set point temperature SP minus an eighth predetermined temperature valve ("$T_8$"), such as for example 3.0° F., and a lower limit of the set point temperature SP minus a ninth predetermined temperature value ("$T_9$"), such as for example 5° F. If the return air temperature TRA comes within the temperature range 188, the second control algorithm 142 operates the system 10 in low speed heat maximum capacity LSHMC. If the return air temperature TRA remains in the temperature range 188 for a predetermined time period (e.g., 8 minutes), the second control algorithm 142 shifts the system 10 into the high speed heat mode HSHM and continues to operate in the high speed heat mode HSHM until the return air temperature TRA returns to the temperature range 186.

If the return air temperature TRA comes within a temperature range 190, the second control algorithm 142 calls for operating the system 10 in low speed cool maximum capacity LSCMC. The temperature range 190 has a lower limit of the sum of the set point temperature SP and the seventh predetermined temperature value ("$T_7$"). As shown in FIG. 3, if low speed cool is initiated, the program 130 proceeds to block 132.

Occasionally, water vapor from the conditioned space 14 can be separated from the air and can condense on the evaporator coil 62, forming frost. To minimize the formation of frost on the evaporator coil 62 and to remove frost from the evaporator coil 62, the program 130 periodically operates the refrigeration system 10 in the defrost mode. When defrost is required, the program 130 temporarily suspends operation in the first or second control algorithms 140, 142 until the defrost mode is completed and then returns to operation according to the first or second control algorithm 140, 142.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims.

For example, the present invention is described herein as being used to pull down and maintain the temperature in a trailer 12 having a single air-conditioned space 14. However, one having ordinary skill in the art will appreciate that the present invention could also be used in trucks or trailers having multiple air-conditioned spaces 14. Similarly, the present invention can also be used to pull down and maintain the temperature in buildings, containers, and the like.

Also, the present invention is described herein as including first, second, third, fourth, fifth, sixth, seventh, eighth, and ninth predetermined temperature values $T_1$, $T_2$, $T_3$, $T_4$, $T_5$, $T_6$, $T_7$, $T_8$, $T_9$, which are selected based upon load conditions. Therefore, the any or all of the predetermined temperature values may be changed or may be entered by the operator or system administrator to reconfigure the program 130 to heat and cool different cargoes. Similarly, the temperature ranges 156, 158, 160, 162, 186, 188, 190 may also be altered based upon load conditions or may be altered or adjusted by the operator or a system administrator.

As such, the functions of the various elements and assemblies of the present invention can be changed to a significant degree without departing from the spirit and scope of the present invention.

What is claimed is:

1. A method of operating a refrigeration system designed to condition a conditioned space to a set point temperature, the system having a discharge port that guides conditioned air from the system to the conditioned space and a return port that guides air from the conditioned space back to the system, the method comprising:

providing a first control algorithm and second control algorithm for controlling the system, the first control algorithm being a function of the air temperature at the discharge port, and the second control algorithm being a function of the air temperature at the return port;

operating the system using the first control algorithm when a first condition is met, and operating the system using the second control algorithm when a second condition is met; and automatically switching between the first control algorithm and the second control algorithm depending on the status of the first condition and the second condition.

2. The method of claim 1 further comprising measuring a temperature of ambient air outside of the conditioned space, wherein the first and second conditions are a function of the ambient air temperature.

3. The method of claim 2 wherein the first condition comprises the ambient temperature being greater than or equal to the set point.

4. The method of claim 2 wherein the second condition comprises the ambient temperature being less than the set point.

5. The method of claim 1 wherein operating the system using the first control algorithm when a first condition is met, and operating the system using the second control algorithm when a second condition is met includes:

measuring a temperature of ambient air outside of the conditioned space;

comparing the ambient air temperature to the set point;

controlling the system utilizing the first control algorithm if the ambient air temperature is greater than or equal to the set point; and controlling the system utilizing the second control algorithm if the ambient air temperature is less than the set point.

6. The method of claim 1 wherein the system can operate in a high speed heat mode or a low speed heat modulation mode, and wherein operating the system using the second control algorithm when the second condition is met includes:

operating the system in the high speed heat mode if the return air temperature is more than about 5 degrees below the set point; and operating the system in the low speed heat modulation mode if the return air temperature is less than about 1.5 degrees above the set point.

7. The method of claim 1 wherein the system can operate in a high speed heat mode, a low speed heat modulation mode, and a timed mode, and wherein operating the system using the second control algorithm when the second condition is met includes:

operating the system in the low speed heat mode if the return air temperature is less than about 1.5 degrees above the set point;

operating the system in the timed mode a predetermined period of time if the return air temperature is more than about 3 degrees below the set point temperature; and operating the system in the high speed heat mode if the return air temperature is more than about 3 degrees below the set point temperature for the predetermined period of time.

8. The method of claim 1 wherein the system can operate in a low speed cool modulation mode and a low speed cool mode, and wherein operating the system using the first control algorithm when the first condition is met includes:

operating the system in low speed cool mode if the return air temperature is less than about 0.5 degrees below the set point; and operating the system in low speed cool modulation mode if the return air temperature is less than about 3 degrees above than the set point.

9. The method of claim 1 wherein the system can operate in a low speed cool modulation mode, a high speed cool mode, and a timed mode, and wherein operating the system using the first control algorithm when the first condition is met includes:

operating the system in the low speed cool modulation mode if the discharge air temperature is less than about 5.0 degrees above the set point;

operating the system in the timed mode a predetermined period of time if the discharge air temperature is more than about 5.0 degrees above the set point temperature; and operating the system in the high speed cool mode if the discharge air temperature is more than about 5.0 degrees above the set point temperature for the predetermined period of time.

10. The method of claim 1 wherein the system can operate in a high speed cool mode or a low speed cool modulation mode, and wherein operating the system using the first control algorithm when a first condition is met includes:

operating the system in the high speed cool mode if the discharge air temperature is more than about 3 degrees above the set point; and operating the system in the low speed cool modulation mode if the discharge air temperature is less than about 3 degrees above the set point.

11. The method of claim 1 wherein the system can operate in low speed heat mode or low speed cool modulation mode, and wherein the step of controlling the system utilizing the second algorithm includes:

operating the system in low speed heat mode if the return air temperature is less than about 1.5 degrees more than the set point; and operating the system in low speed cool modulation mode if the return air temperature is greater than about 1.5 degrees more than the set point.

12. A method of operating a refrigeration system designed to condition the air of a conditioned space to a set point, the system having a discharge port that guides conditioned air from the system to the conditioned space and a return port that guides air from the conditioned space back to the system, the system being operable in discharge air control wherein control of the system is a function of the temperature of the air in the discharge port, and the system being operable in return air control wherein control of the system is a function of the temperature of the air in the return port, the method comprising:

operating the system using discharge air control when a first condition is met, and operating the system using return air control when a second condition is met; and automatically switching between discharge air control and return air control depending on the status of the first condition and the second condition.

13. The method of claim 12 further comprising measuring ambient air temperature of the air outside of the conditioned space, wherein the first and second conditions are a function of the ambient air temperature.

14. The method of claim 13 wherein the first condition comprises the ambient temperature being greater than or equal to the set point.

15. The method of claim 13 wherein the second condition comprises the ambient temperature being less than the set point.

16. The method of claim 12 wherein the operating step comprises:

measuring a temperature of ambient air outside of the conditioned space;

comparing the ambient air temperature to the set point;

controlling the system utilizing discharge air temperature if the ambient air temperature is greater than or equal to the set point; and controlling the system utilizing return air temperature if the ambient air temperature is less than the set point.

17. The method of claim 12 wherein the system can operate in high speed heat mode or low speed cool modulation mode, and wherein the step of controlling the system utilizing the first algorithm includes:

operating the system in high speed heat mode if the discharge air temperature is less than about 3.0 above the set point; and operating the system in low speed cool modulation mode if the return air temperature is less than about 3.0 degrees above than the set point.

18. The method of claim 12 wherein the system can operate in low speed cool modulation mode or low speed cool mode, and wherein the step of controlling the system utilizing the second control algorithm includes:

operating the system in low speed cool modulation mode if the return air temperature is less than about 0.5 degrees more than the set point; and operating the system in low speed cool mode if the return air temperature is greater than about 0.5 degrees more than the set point.

19. The method of claim 12 wherein the system can operate in high speed cool mode or low speed cool modulation mode, and wherein the step of controlling the system utilizing the first algorithm includes:

operating the system in high speed cool mode if the discharge air temperature is greater than about 3 degrees more than the set point; and operating the system in low speed cool modulation mode if the discharge air temperature is less than about 3 degrees more than the set point.

20. The method of claim 12 wherein the system can operate in low speed heat mode or low speed cool modulation mode, and wherein the step of controlling the system utilizing the second algorithm includes:

operating the system in low speed heat mode if the discharge air temperature is less than about 1 degrees more than the set point; and operating the system in low speed cool modulation mode if the discharge air temperature is greater than about 1 degrees more than the set point.

21. A refrigeration system comprising:

heat exchanger having an air discharge port and an air return port;

a first sensor positioned in the discharge port;

a second sensor positioned in the return port;

a controller in electrical communication with the first sensor and the second sensor, the controller alternately using a first control algorithm to control the system when a first condition is met and using a second control algorithm to control the system when a second condition is met, the first control algorithm being a function of the air temperature at the discharge port, the second control algorithm being a function of the air temperature at the return port.

22. The refrigeration system of claim 21 wherein the discharge port and the air return port are in thermal communication with an air conditioned space and further comprising a third sensor positioned outside the heat exchanger, the first and second conditions being a function of the ambient air temperature.

23. The refrigeration system of claim 22 wherein the first condition comprises the ambient temperature being greater than or equal to the set point.

24. The refrigeration system of claim 22 wherein the second condition comprises the ambient temperature being less than the set point.

* * * * *